US011781285B2

(12) United States Patent
Amano et al.

(10) Patent No.: US 11,781,285 B2
(45) Date of Patent: Oct. 10, 2023

(54) CONSTRUCTION MACHINE

(71) Applicant: Hitachi Construction Machinery Co., Ltd., Tokyo (JP)

(72) Inventors: Hiroaki Amano, Tsukuba (JP); Kento Kumagai, Ami-machi (JP); Shinji Nishikawa, Kasumigaura (JP); Akihiro Narazaki, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/632,668

(22) PCT Filed: Aug. 28, 2020

(86) PCT No.: PCT/JP2020/032712
§ 371 (c)(1),
(2) Date: Feb. 3, 2022

(87) PCT Pub. No.: WO2021/054088
PCT Pub. Date: Mar. 25, 2021

(65) Prior Publication Data

US 2022/0282450 A1 Sep. 8, 2022

(30) Foreign Application Priority Data

Sep. 20, 2019 (JP) ..... 2019-172094

(51) Int. Cl.
*E02F 9/22* (2006.01)
*E02F 9/12* (2006.01)
*F15B 11/028* (2006.01)

(52) U.S. Cl.
CPC ..... *E02F 9/2203* (2013.01); *E02F 9/123* (2013.01); *E02F 9/2235* (2013.01);
(Continued)

(58) Field of Classification Search
CPC ..... E02F 9/2203; E02F 9/2232; E02F 9/2235; F15B 11/0423
See application file for complete search history.

(56) References Cited

U.S. PATENT DOCUMENTS 9,624,647 B2 * 4/2017 Yamashita ..... G05B 11/14
11,111,931 B2 * 9/2021 Muraoka ..... F15B 11/0406
(Continued)

FOREIGN PATENT DOCUMENTS

JP 2-76906 A 3/1990
JP H09189302 A * 7/1997 ..... E02F 9/2203
(Continued)

OTHER PUBLICATIONS

International Search Report (PCT/ISA/210) issued in PCT Application No. PCT/JP2020/032712 dated Oct. 27, 2020 with English translation (five (5) pages).
(Continued)

*Primary Examiner* — Michael Leslie
(74) *Attorney, Agent, or Firm* — Crowell & Moring LLP

(57) ABSTRACT

Provided is a construction machine which can promptly adjust the rotational speed of a swing motor to a target rotational speed. A controller calculates a target rotational speed of the swing motor based on input from an operation device, calculates a degree of deviation of a rotational speed detected by a rotational speed sensor from the target rotational speed, sets a target driving pressure of the swing motor according to a moment of inertia about a swing axis of a swing structure and a work device and controls a pressure adjusting device in such a manner as to reduce a difference between a driving pressure detected by a pressure sensor and the target driving pressure, when the degree of deviation is larger than a predetermined value, and controls the pressure adjusting device in such a manner as to reduce a difference between the rotational speed detected by the
(Continued)

rotational speed sensor and the target rotational speed, when the degree of deviation is equal to or smaller than the predetermined value.

3 Claims, 13 Drawing Sheets

(52) U.S. Cl.
CPC ..... *E02F 9/2296* (2013.01); *F15B 11/028* (2013.01); *F15B 2211/7058* (2013.01)

(56) References Cited

U.S. PATENT DOCUMENTS

| | | | | |
|---|---|---|---|---|
| 11,149,757 | B2 * | 10/2021 | Yumoto | F15B 11/0423 |
| 11,162,242 | B2 * | 11/2021 | Kozui | E02F 9/123 |
| 2014/0166135 | A1 | 6/2014 | Yamashita et al. | |

FOREIGN PATENT DOCUMENTS

| | | | |
|---|---|---|---|
| JP | 11-81389 | A | 3/1999 |
| JP | 2012-246944 | A | 12/2012 |

OTHER PUBLICATIONS

Japanese-language Written Opinion (PCT/ISA/237) issued in PCT Application No. PCT/JP2020/032712 dated Oct. 27, 2020 (four (4) pages).

International Preliminary Report on Patentability (PCT/IB/338 & PCT/IB/373) issued in PCT Application No. PCT/JP2020/032712 dated Mar. 31, 2022, including English translation of document C2 (Japanese-language Written Opinion (PCT/ISA/237), filed on Feb. 3, 2022 (six (6) pages).

* cited by examiner

CONSTRUCTION MACHINE

TECHNICAL FIELD

The present invention relates to a construction machine such as a hydraulic excavator.

BACKGROUND ART

In a swing type work machine that rotationally drives a swing structure by a swing motor, publicly known is a technology which performs swing acceleration while maintaining a swing motor differential pressure at a relief set pressure by discharging, from a relief valve attached to the swing motor, oil delivered from a hydraulic pump.

In a swing driving system of such a work machine, the high pressure fluid discharged from the relief valve represents energy discarded as heat, and efficiency is thus poor. In order to deal with this, in Patent Document 1, a swing motor supply flow rate is determined from a deviation of a target rotational speed of the swing motor, which is obtained from an operation amount, from an actual rotational speed of the swing motor, which is detected from a sensor, and a pump flow rate is controlled in such a manner as to obtain the swing motor supply flow rate. It is assumed that an excess flow rate can thereby be reduced and that energy efficiency is consequently improved. In addition, Patent Document 1 supposes that a speed following characteristic can also be adjusted by adding a result of multiplication of the deviation between the target rotational speed and the actual rotational speed by a gain to the target rotational speed, thereby setting a secondary target rotational speed, and controlling a pump delivery flow rate based on this secondary target rotational speed.

PRIOR ART DOCUMENT

Patent Document

Patent Document 1: JP-2012-246944-A

SUMMARY OF THE INVENTION

Problems to be Solved by the Invention

The rotational acceleration of the swing motor is determined by a swing motor torque (pressure across the swing motor in a case where the swing motor is of a fixed displacement type). In Patent Document 1, the speed following characteristic is adjusted by correcting the target rotational speed. However, the pressure across the swing motor becomes a random value determined from a swing flow rate and a swing motor rotational speed at the time or a relief setting pressure. Hence, the swing motor torque cannot be adjusted, and a desired rotational acceleration intended by an operator may not be obtained.

The present invention has been made in view of the above-described problems. It is an object of the present invention to provide a construction machine that can promptly adjust the rotational speed of a swing motor to a target rotational speed.

Means for Solving the Problems

In order to achieve the above object, according to the present invention, there is provided a construction machine including a track structure, a swing structure swingably attached onto the track structure, a work device attached to the swing structure, a hydraulic operating fluid tank; a hydraulic pump that delivers hydraulic operating fluid sucked from the hydraulic operating fluid tank, a swing motor that is supplied with the hydraulic operating fluid from the hydraulic pump and drives the swing structure, and an operation device for giving an instruction for operation of the swing structure, wherein the construction machine comprises a rotational speed sensor that detects a rotational speed of the swing motor, a pressure sensor that detects a driving pressure of the swing motor, a pressure adjusting device capable of adjusting the driving pressure of the swing motor, and a controller that controls the pressure adjusting device, and the controller is configured to calculate a target rotational speed of the swing motor based on input from the operation device, calculate a degree of deviation of the rotational speed detected by the rotational speed sensor from the target rotational speed, set a target driving pressure of the swing motor according to a moment of inertia about a swing axis of the swing structure and the work device and control the pressure adjusting device in such a manner as to reduce a difference between the driving pressure detected by the pressure sensor and the target driving pressure, when the degree of deviation is larger than a predetermined value, and control the pressure adjusting device in such a manner as to reduce a difference between the rotational speed detected by the rotational speed sensor and the target rotational speed, when the degree of deviation is equal to or smaller than the predetermined value.

According to the present invention configured as described above, when the degree of deviation of the rotational speed of the swing motor from the target rotational speed is larger than the predetermined value (that is, when the rotational speed of the swing motor is significantly below the target rotational speed), the driving pressure of the swing motor is controlled in such a manner as to coincide with the target driving pressure set according to the swing moment as a moment of inertia about the swing axis of the swing structure and the work device, and when the degree of deviation is equal to or smaller than the predetermined value (that is, when the rotational speed of the swing motor approaches the target rotational speed), the driving pressure of the swing motor is controlled such that the rotational speed of the swing motor coincides with the target rotational speed. It is thereby possible to promptly adjust the rotational speed of the swing motor to the target rotational speed.

Advantages of the Invention

The construction machine according to the present invention can promptly adjust the rotational speed of the swing motor to the target rotational speed.

MODES FOR CARRYING OUT THE INVENTION

Figure 1:
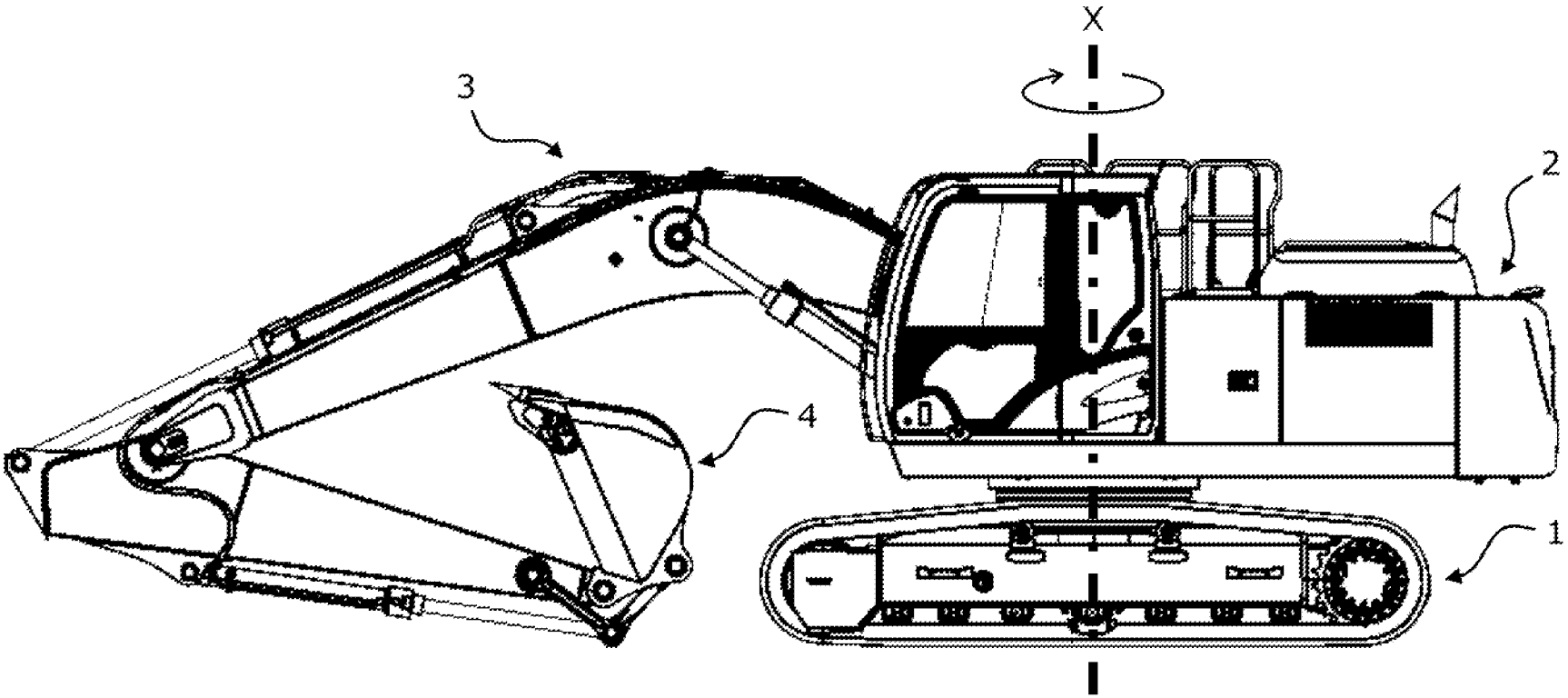
FIG. 1 is a general view of a hydraulic excavator according to an embodiment of the present invention.

An embodiment of the present invention will hereinafter be described with reference to the drawings by taking a hydraulic excavator as a construction machine, for example. Incidentally, in the figures, similar members are identified by the same reference numerals, and repeated description thereof will be omitted as appropriate.

FIG. 1 depicts a hydraulic excavator according to the present embodiment. In FIG. 1, the hydraulic excavator includes a track structure 1, a swing structure 2 provided on the track structure 1 in such a manner as to be swingable about a swing axis X, and a work device 3 installed on the swing structure 2. A bucket 4 as a work tool is attached to a distal end of the work device 3. The swing structure 2 is provided with a swing motor 17 (depicted in FIG. 2) and a speed reduction mechanism (not depicted) for the swing motor 17. The swing motor 17 swing-drives the swing structure 2 with respect to the track structure 1.

Figure 2:
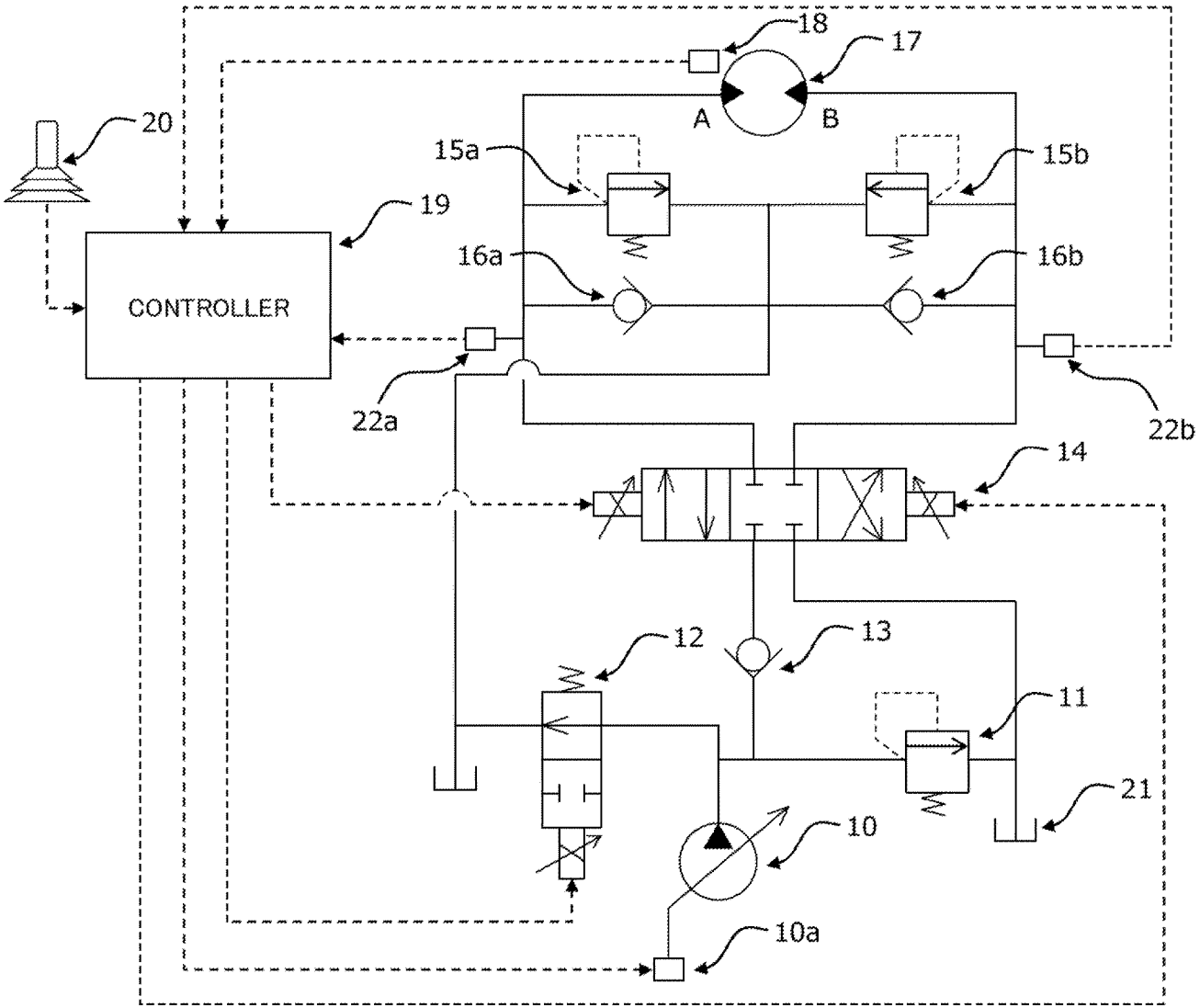
FIG. 2 is a hydraulic circuit diagram of a hydraulic control system included in the hydraulic excavator according to the embodiment of the present invention.

FIG. 2 depicts a hydraulic circuit of a hydraulic control system included in the hydraulic excavator (depicted in FIG. 1). Incidentally, in FIG. 2, parts related to the driving of hydraulic actuators other than the swing motor 17 are omitted.

The hydraulic control system in the present embodiment includes a hydraulic pump 10 of a variable displacement type, a pump regulator 10*a* capable of changing the delivery flow rate (pump flow rate) of the hydraulic pump 10, and the swing motor 17. Hydraulic fluid delivered from the hydraulic pump 10 is fed to the swing motor 17 through a load check valve 13 and a directional control valve 14. The delivery pressure of the hydraulic pump 10 can be adjusted by controlling the aperture of a hydraulic line to a hydraulic operating fluid tank 21 by a bleed-off valve 12. In addition, a delivery port of the hydraulic pump 10 is connected to the hydraulic operating fluid tank 21 via a main relief valve 11. The main relief valve 11 defines an upper limit of the delivery pressure of the hydraulic pump 10.

Two ports (an A-port and a B-port) of the swing motor 17 are respectively provided with swing relief valves 15*a* and 15*b* and makeup check valves 16*a* and 16*b*. The swing relief valves 15*a* and 15*b* perform an excessive load preventing function for the swing motor 17. The makeup check valves 16*a* and 16*b* perform an anti-void function for the swing motor 17.

In addition, the hydraulic control system in the present embodiment includes a rotational speed sensor 18 that detects the rotational speed of the swing motor 17, a controller 19, a joystick 20 as an operation device for inputting an operation signal, and pressure sensors 22*a* and 22*b* that respectively detect the pressures of the A-port and the B-port of the swing motor 17. The controller 19 obtains an actual rotational speed of the swing motor 17 from the rotational speed sensor 18, obtains a swing operation signal from the joystick 20, and obtains the A-port and B-port pressures of the swing motor 17 from the pressure sensors 22*a* and 22*b*. The controller 19 performs computation based on these signals, and outputs control signals to the pump regulator 10*a*, the bleed-off valve 12, and the directional control valve 14.

Figure 3:
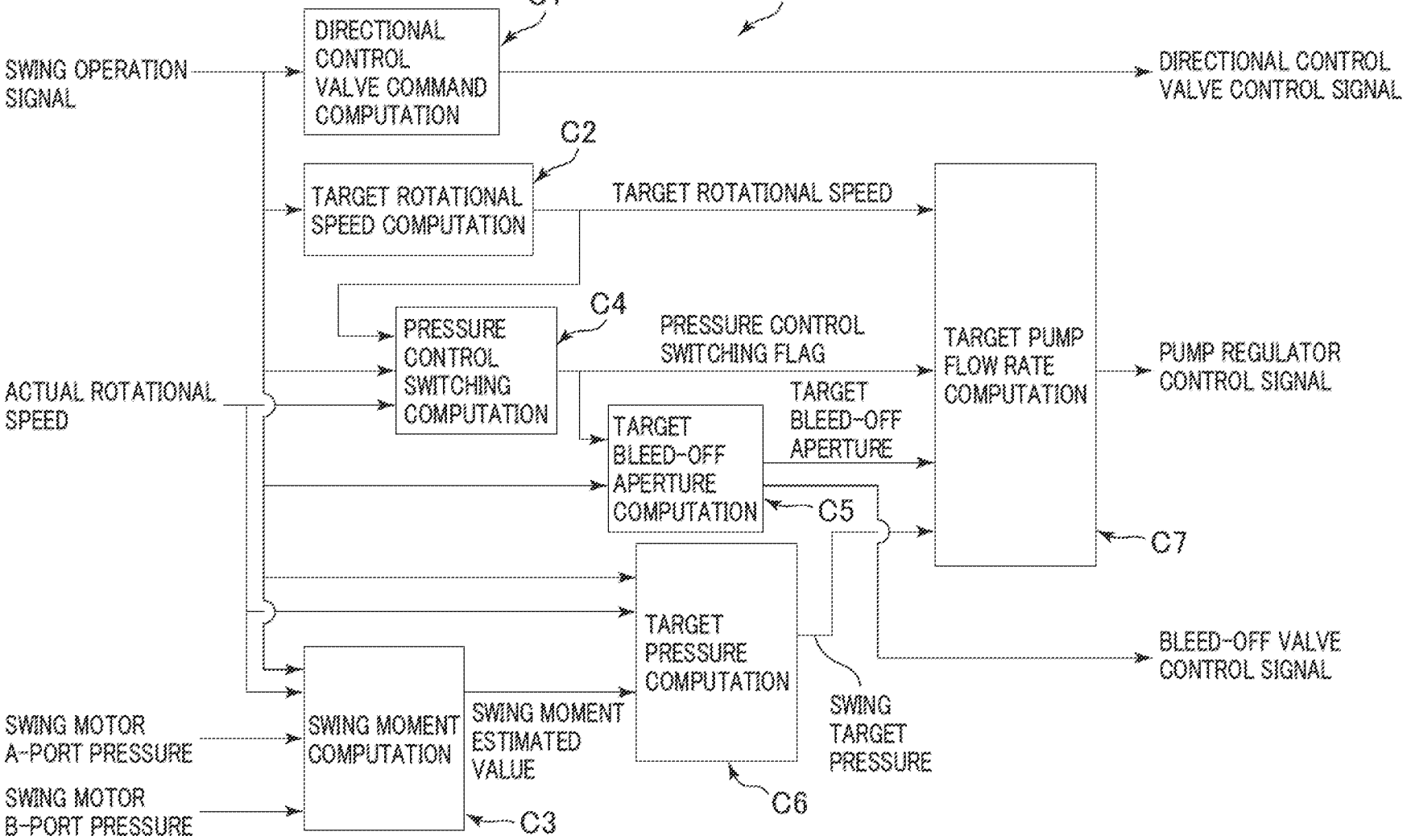
FIG. 3 is a control block diagram of a controller in the embodiment of the present invention.

FIG. 3 depicts control blocks of the controller 19. A control section C1 is supplied with the swing operation signal, and outputs a directional control valve control signal. A control section C2 is supplied with the swing operation signal, and outputs a target rotational speed. A control section C3 is supplied with the actual rotational speed and the swing motor A-port pressure and the swing motor B-port pressure, and outputs a swing moment estimated value. Incidentally, suppose that a swing moment here represents a moment of inertia about the swing axis X of the swing structure 2 and the work device 3 as viewed from the swing motor 17 side, and includes an effect of a reduction gear.

A control section C4 is supplied with the swing operation signal, the target rotational speed outputted by the control section C2, and the actual rotational speed, and outputs a pressure control switching flag. A control section C5 is supplied with the pressure control switching flag outputted by the control section C4 and the swing operation signal, and outputs a target bleed-off aperture. A control section C6 is supplied with the swing equivalent moment outputted by the control section C3, the swing operation signal, and the actual rotational speed, and outputs a swing target pressure. A control section C7 calculates a target pump flow rate from the target rotational speed outputted by the control section C2, the pressure control switching flag outputted by the control section C4, the target bleed-off aperture outputted by the control section C5, and the swing target pressure outputted by the control section C6, and outputs a pump regulator control signal corresponding to the target pump flow rate.

Figure 4:
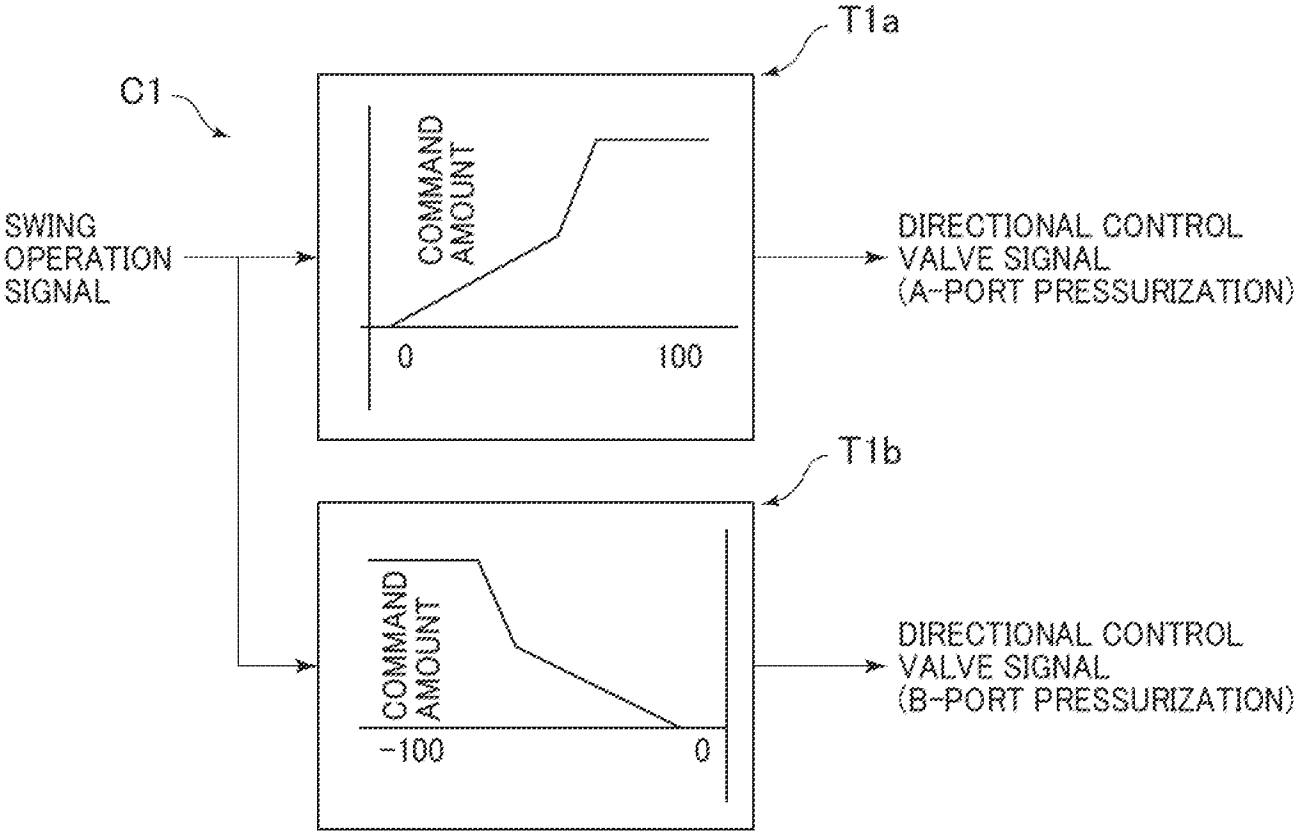
FIG. 4 is a detailed view (1/8) of a control block of the controller in the embodiment of the present invention.

FIG. 4 depicts details of the control section C1. In the control section C1, the swing operation signal is inputted to each of control tables T1*a* and T1*b*. The control table T1*a* outputs a directional control valve control signal (A-port pressurization) according to the magnitude of the swing operation signal when the swing operation signal is positive. The control table T1*b* outputs a directional control valve control signal (B-port pressurization) according to the magnitude of the swing operation signal when the swing operation signal is negative.

Figure 5:
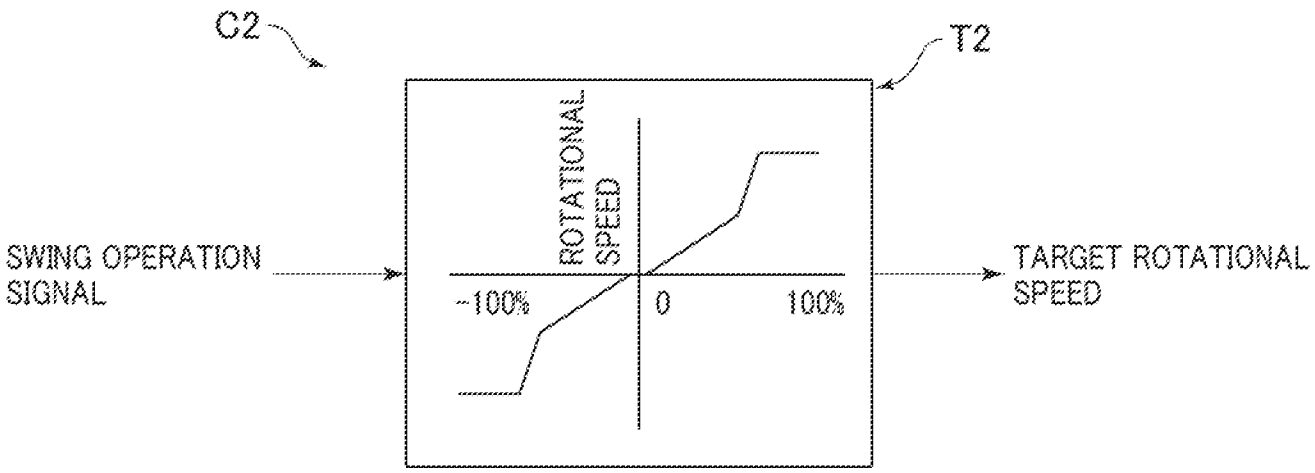
FIG. 5 is a detailed view (2/8) of a control block of the controller in the embodiment of the present invention.

FIG. 5 depicts details of the control section C2. In the control section C2, the swing operation signal is inputted to a control table T2. The control table T2 outputs the target rotational speed of the swing motor according to the value of the swing operation signal. Here, suppose that, when the swing operation signal is positive, the target rotational speed is that of a positive rotation, and is associated with a right swing.

Figure 6:
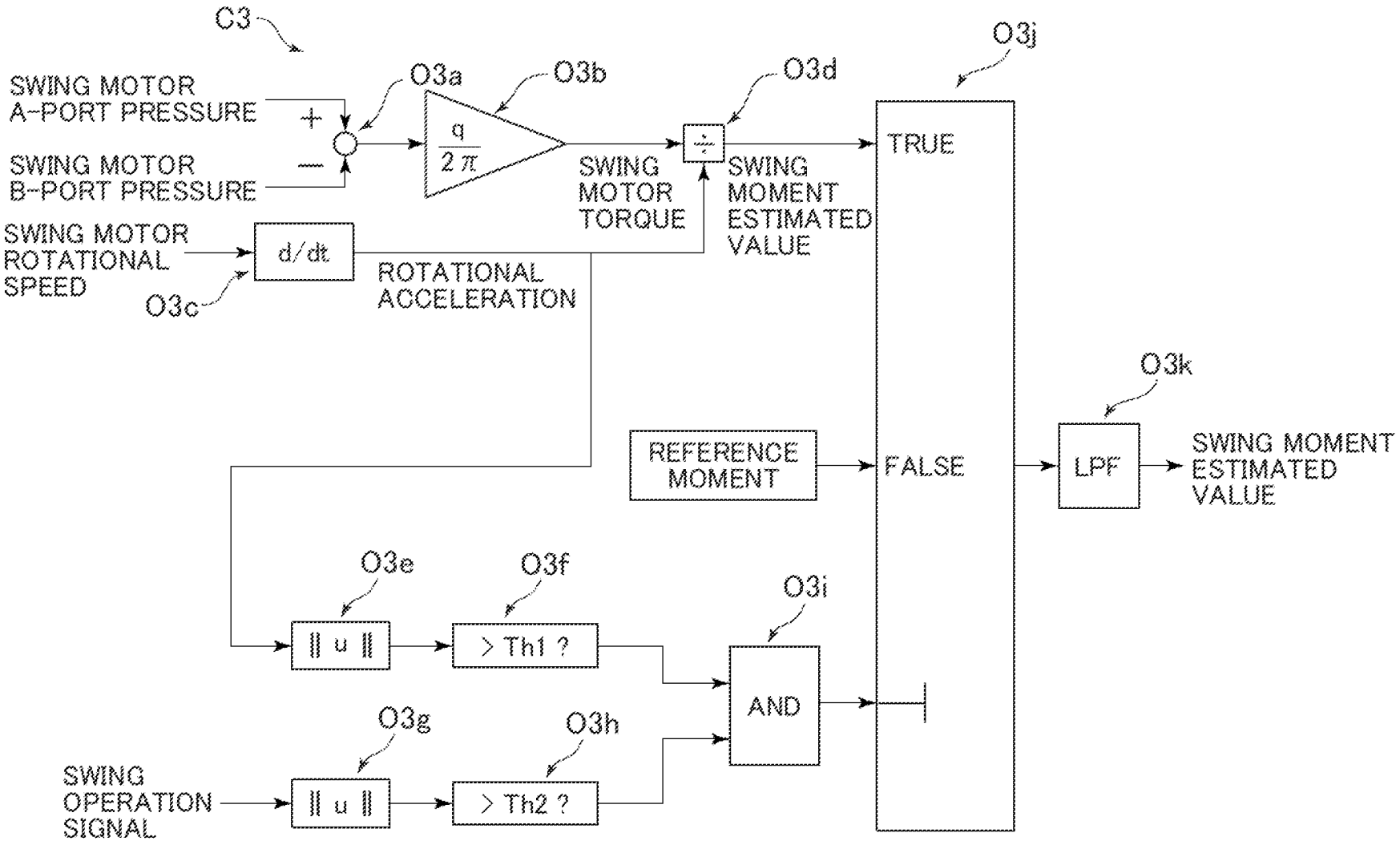
FIG. 6 is a detailed view (3/8) of a control block of the controller in the embodiment of the present invention.

FIG. 6 depicts details of the control section C3. Computing sections O3*a* and O3*b* calculate a swing motor torque by multiplying a differential pressure obtained by subtracting the B-port pressure from the swing motor A-port pressure by a swing motor volume q, and dividing a result of the multiplication by 2π. A computing section O3*c* calculates a rotational acceleration by differentiating the swing motor rotational speed. A computing section O3*d* calculates the swing moment estimated value by dividing the swing motor torque by the rotational acceleration, and outputs the swing moment estimated value. Incidentally, at a time of control implementation, a measure to prevent zero division is taken in the computing section O3*d*. Specific measures to prevent the zero division include providing a minimum value of the rotational acceleration.

Computing sections O3*e* and O3*f* determine whether or not the absolute value of the swing motor rotational acceleration exceeds a threshold value Th1 set in the controller 19 in advance. Computing sections O3*g* and O3*h* determine whether or not the swing operation signal exceeds a threshold value Th2 set in the controller 19 in advance. A computing section O3*i* outputs TRUE when the output of the computing section O3*f* and that of the computing section O3*h* are both TRUE. A computing section O3*j* outputs the value from the computing section O3*d* (swing moment estimated value) when the output of the computing section O3*i* is TRUE. The computing section O3*j* outputs a reference moment set in the controller 19 in advance, when the output of the computing section O3*i* is FALSE. A computing section O3*k* performs low-pass filter processing on the output of the computing section O3*j*, and outputs a result of the low-pass filter processing as the swing moment estimated value.

Figure 7:
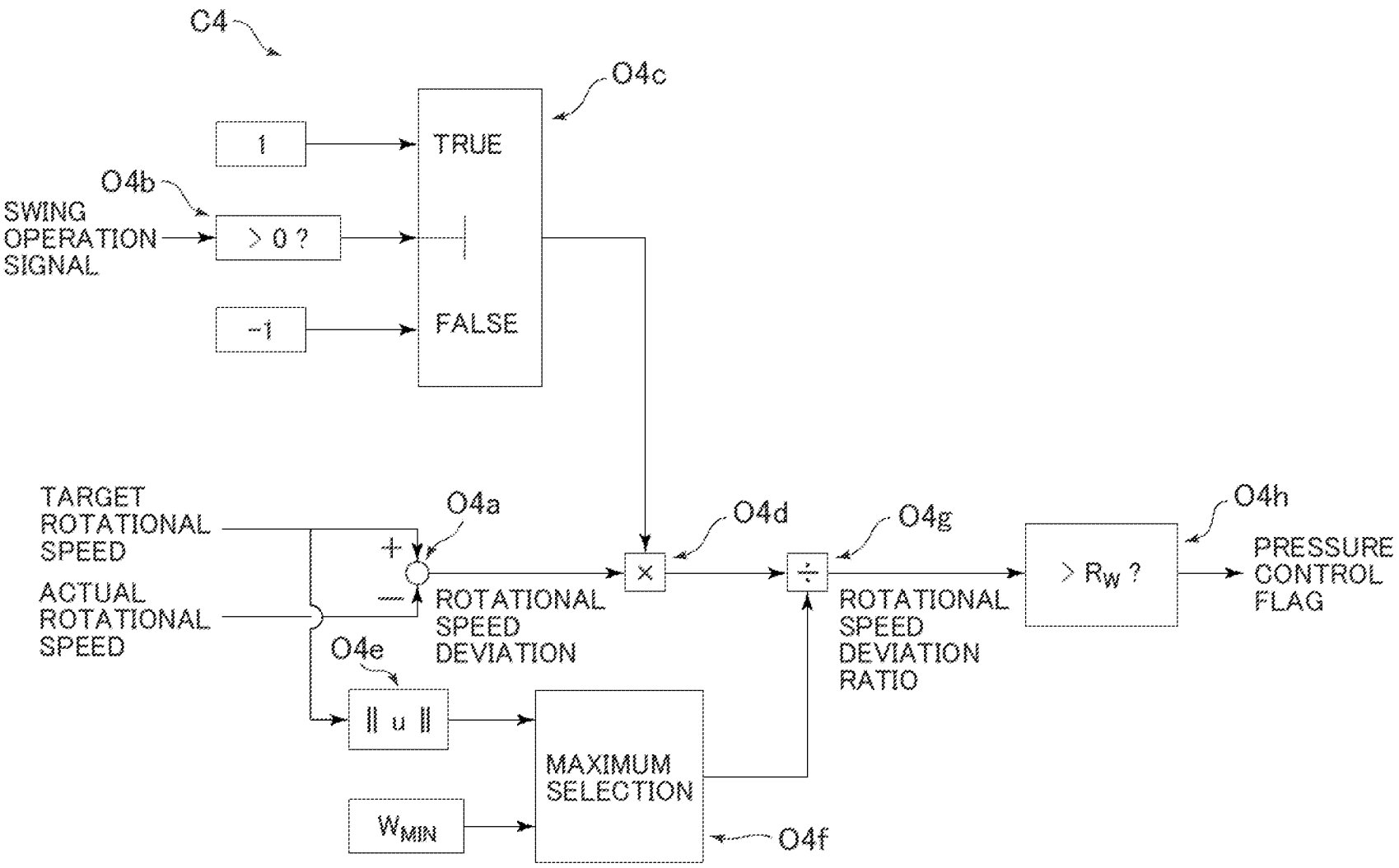
FIG. 7 is a detailed view (4/8) of a control block of the controller in the embodiment of the present invention.

FIG. 7 depicts details of the control section C4. A control section O4*a* calculates a rotational speed deviation by subtracting the actual rotational speed from the target rotational speed. Control sections O4*b* and O4*c* determine whether or not the swing operation signal exceeds 0. When the swing operation signal exceeds 0, the control sections O4*b* and O4*c* output 1. When the swing operation signal does not exceed 0, the control sections O4*b* and O4*c* output −1. A control section O4*d* multiplies the rotational speed deviation by the output of the control section O4*c* (1 or −1). A control section O4*e* outputs the absolute value of the target rotational speed. A control section O4*f* selects a maximum value of the absolute value of the target rotational speed and a minimum rotational speed $W_{MIN}$ set in the controller in advance (which is a rotational speed at which the swing motor 17 can be considered to be practically stopped, and is, for example, 10 rpm), and outputs the maximum value. A control section O4*g* calculates a rotational speed deviation ratio by dividing the rotational speed deviation by the output of the control section O4*f*. A computing section O4*h* compares the rotational speed deviation ratio with a speed deviation ratio threshold value $R_W$ set in the controller in advance (the speed deviation ratio threshold value $R_W$ is, for example, set at 0.2 or the like; in this case, whether or not the speed deviation from a target value exceeds 20% is determined). The computing section O4*h* outputs ON as a pressure control flag when the rotational speed deviation ratio exceeds the speed deviation ratio threshold value $R_W$. The computing section O4*h* outputs OFF as the pressure control flag when the rotational speed deviation ratio is equal to or lower than the speed deviation ratio threshold value $R_W$.

Figure 8:
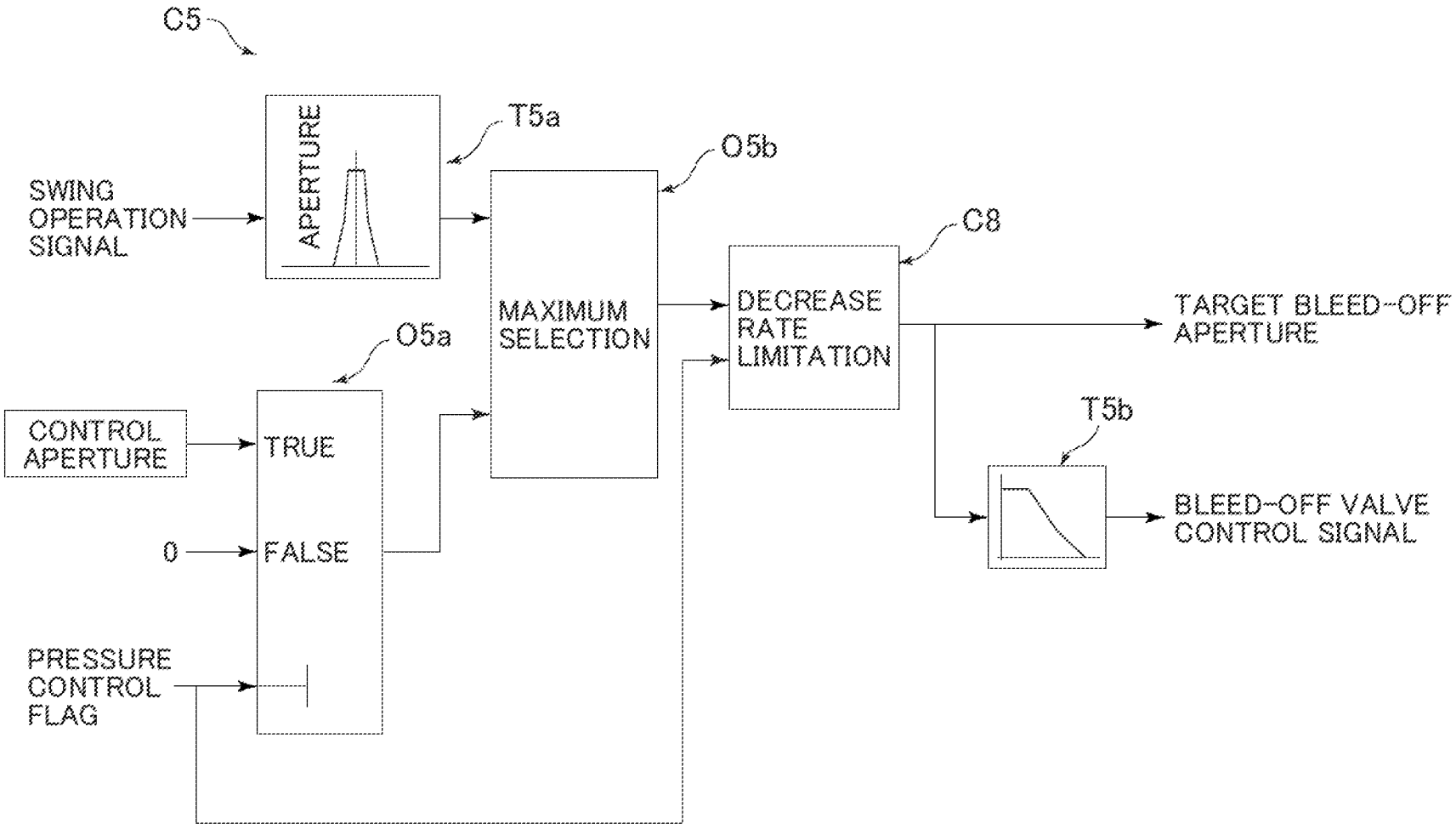
FIG. 8 is a detailed view (5/8) of a control block of the controller in the embodiment of the present invention.

FIG. 8 depicts details of the control section C5. A control table T5*a* converts the swing operation signal into a primary target bleed-off aperture, and outputs the primary target bleed-off aperture. Here, as depicted in FIG. 8, the control table T5*a* has characteristics of providing a maximum aperture when the swing operation signal represents a minute operation amount (for example, ±10% of a maximum operation amount) or less, and becoming zero when the swing operation signal exceeds the minute operation amount. A computing section O5*a* outputs a control aperture (for example, a fixed value of 5 square mm) set in the controller 19 in advance, when the pressure control flag is ON. The computing section O5*a* outputs 0 when the pressure control flag is OFF. A computing section O5*b* selects a maximum value of the output of the control table T5*a* and the output of the computing section O5*a*, and outputs the maximum value to a decrease rate limiting block C8. The decrease rate limiting block C8 calculates the target bleed-off aperture based on the output of the computing section O5*b* and the pressure control flag, and outputs the target bleed-off aperture. A control table T5*b* converts the target bleed-off aperture into a bleed-off valve control signal, and outputs the bleed-off valve control signal.

Figure 9:
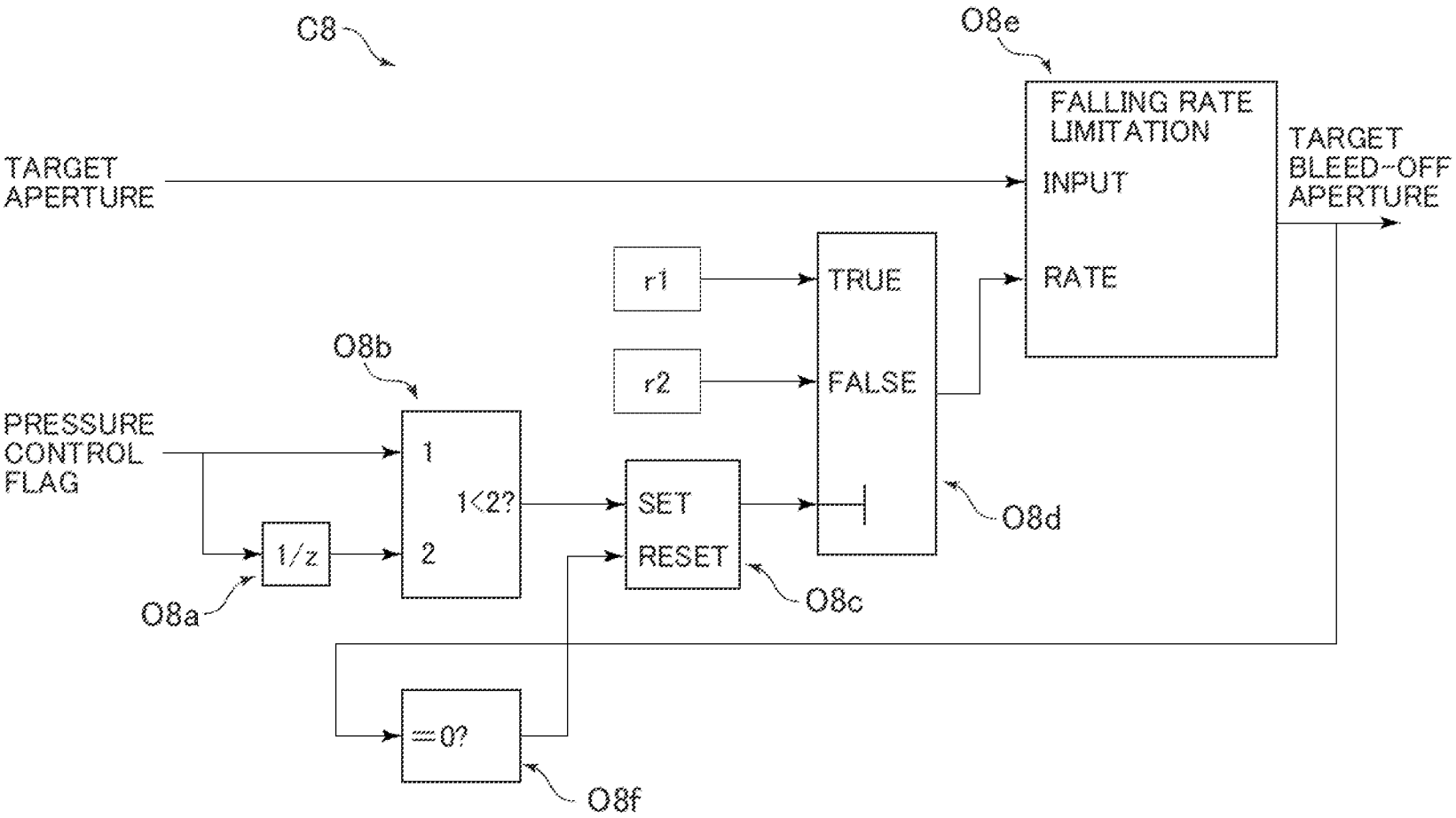
FIG. 9 is a detailed view (6/8) of a control block of the controller in the embodiment of the present invention.

FIG. 9 depicts details of the decrease rate limiting block C8. A computing section O8*a* outputs a value of the pressure control flag which precedes by a unit step time. A computing section O8*b* compares the pressure control flag with the value of the pressure control flag which precedes by a unit step time. When the former is smaller than the latter (when the pressure control flag is switched from ON to OFF), the computing section O8*b* outputs TRUE, and inputs TRUE to a SET terminal of a computing section O8*c*. The computing section O8*c* is what is generally called a flip-flop. The computing section O8*c* outputs TRUE when TRUE is inputted to the SET terminal. The computing section O8*c* continues outputting TRUE until TRUE is inputted to a RESET terminal. A computing section O8*d* selects a rate r1 when input from the computing section O8*c* is TRUE. The computing section O8*d* selects a rate r2 when the input from the computing section O8*c* is FALSE. The computing section O8*d* outputs the selected rate to a falling rate limitation computing section O8*e*. Here, suppose that the rate r1 is a value limited such that a shock at a time of aperture switching is reduced (for example, −10 square mm per second) and that the rate r2 is a value at which the aperture switching can be performed promptly (for example, −1000 square mm per second). The computing section O8*e* performs falling rate limitation on the input target aperture based on the rate outputted from the computing section O8*d*, and outputs a result of the falling rate limitation to a computing section O8*f*. The computing section O8*f* determines whether or not the target aperture obtained after the falling rate limitation is 0. When the target aperture obtained after the falling rate limitation is 0, the computing section O8*f* outputs TRUE, and inputs TRUE to the RESET terminal of the computing section O8*c*.

Figure 10:
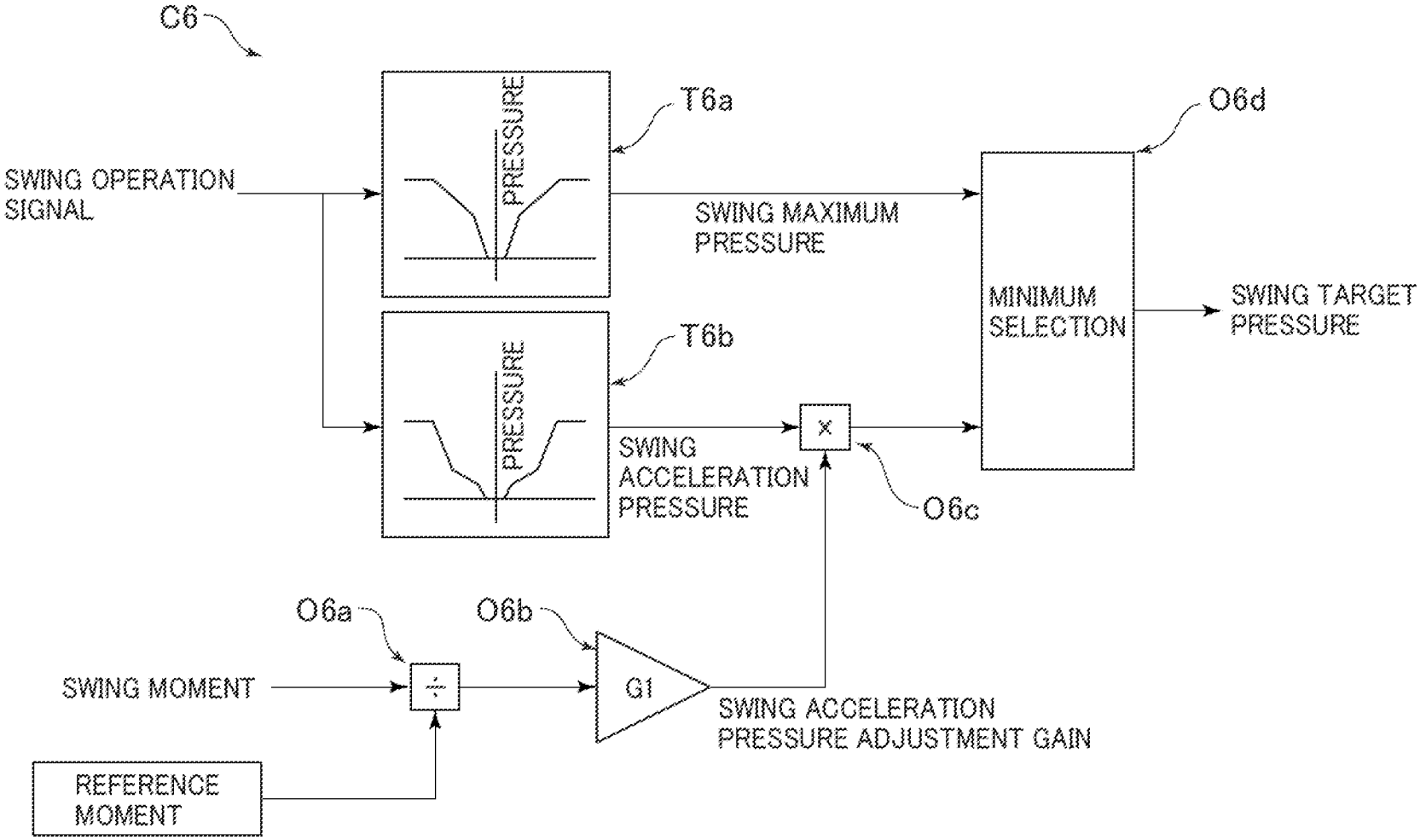
FIG. 10 is a detailed view (7/8) of a control block of the controller in the embodiment of the present invention.

FIG. 10 depicts details of the control section C6. In the control section C6, the swing operation signal is inputted to control tables T6*a* and T6*b*. The control table T6*a* calculates a swing maximum pressure corresponding to the swing operation signal. The control table T6*b* calculates a swing acceleration pressure corresponding to the swing operation signal. Computing sections O6*a* and O6*b* calculate a swing acceleration pressure adjustment gain by dividing the calculated value of the swing moment by a swing reference moment set in the controller 19 in advance, and further multiplying a result of the division by a gain G1 set in the controller 19 in advance. A computing section O6*c* multiplies together the swing acceleration pressure and the swing acceleration pressure adjustment gain, and outputs a result of the multiplication to a computing section O6*d*. The computing section O6*d* selects a minimum value of the output of the computing section O6*c* and the swing maximum pressure, and outputs the minimum value as the swing target pressure.

Figure 11:
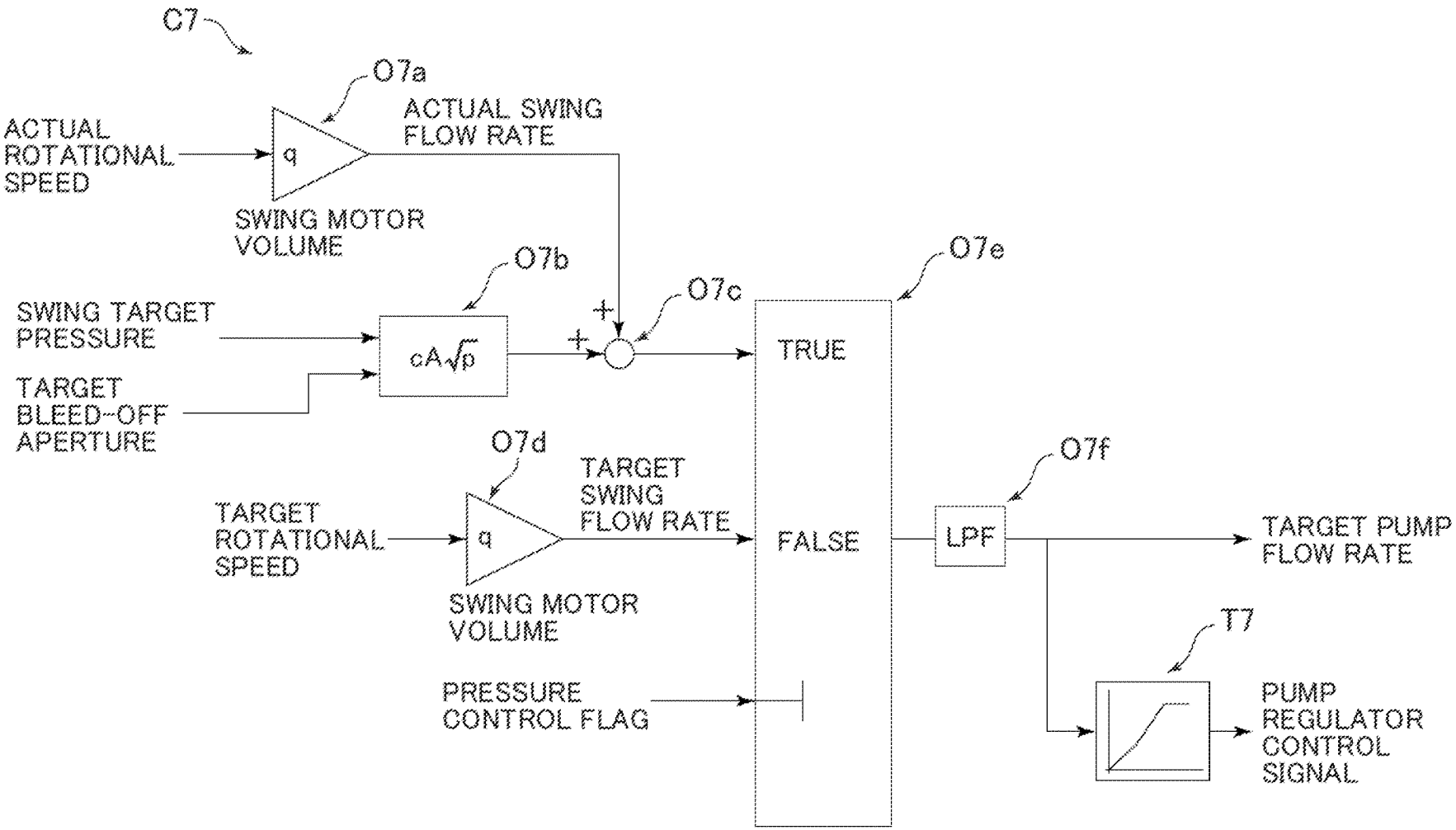
FIG. 11 is a detailed view (8/8) of a control block of the controller in the embodiment of the present invention.

FIG. 11 depicts details of the control section C7. A computing section O7*a* calculates an actual swing flow rate by multiplying the actual rotational speed by the swing motor volume q. A computing section O7*b* is supplied with the swing target pressure and the target bleed-off aperture. The computing section O7*b* sets c as a coefficient, sets A as a target aperture, and sets p as a target pressure, to calculate a bleed-off flow rate target value by using a relation $cA_p^{1/2}$. A computing section O7*c* adds together the actual swing flow rate and the bleed-off flow rate target value, and inputs a result of the addition to a computing section O7*e*. A computing section O7*d* calculates a swing target flow rate by multiplying the target rotational speed by the swing motor volume q. The computing section O7*e* selects and outputs the output of the computing section O7*c* when the pressure control flag is ON. The computing section O7*e* selects and outputs the output of the computing section O7*d* when the pressure control flag is OFF. The output of the computing section O7*e* is outputted as the target pump flow rate through a low-pass filter O7*f*. In addition, a control table T7 converts the target pump flow rate into a pump regulator command value, and outputs the pump regulator command value.

Figure 12:
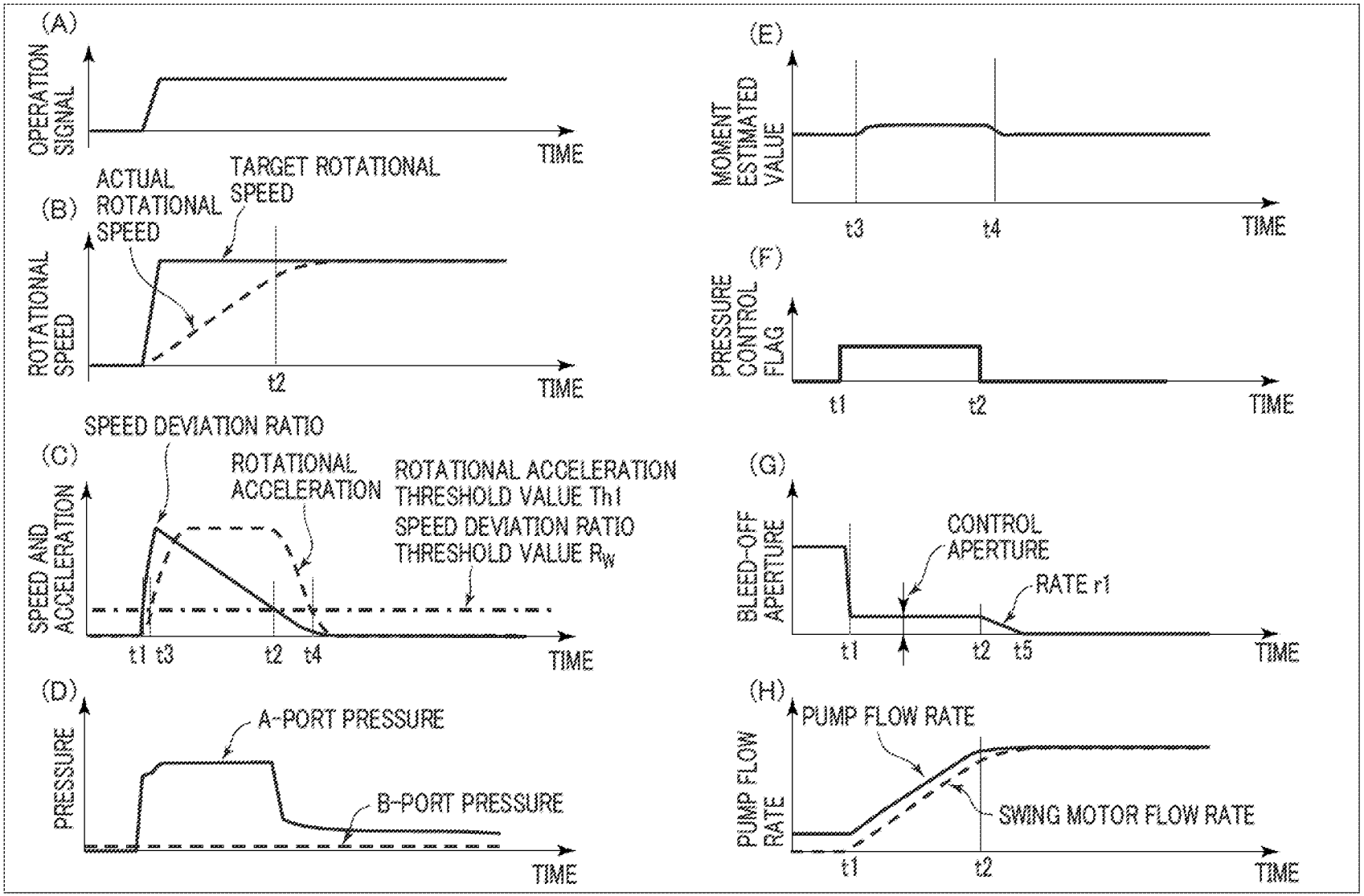
FIG. 12 is a diagram illustrating temporal changes in signals and control amounts when a right swing full lever operation is performed in a state in which a swing moment is small in the embodiment of the present invention.

FIG. 12 depicts temporal changes in signals and control amounts when a right swing full lever operation is performed in a state in which the swing moment is small (in a state in which the bucket 4 is empty).

A graph (A) depicts temporal changes in the swing operation signal.

A graph (B) depicts temporal changes in the target rotational speed and the actual rotational speed of the swing motor 17. The target rotational speed rises according to the swing operation signal. The actual rotational speed increases as a swing motor pressure to be described later rises.

A graph (C) depicts temporal changes in the ratio of the deviation between the target rotational speed and the actual rotational speed of the swing motor 17 to the target rotational speed (speed deviation ratio) and the rotational acceleration. A solid line in the figure represents the speed deviation ratio. A broken line in the figure represents the rotational acceleration. Alternate long and short dashed lines in the figure represent the rotational acceleration threshold value Th1 and the speed deviation ratio threshold value $R_W$. Suppose that a time at which the speed deviation ratio exceeds the speed deviation ratio threshold value $R_W$ after a start of a swing operation is t1, and that a time at which the speed deviation ratio becomes equal to or lower than the speed deviation ratio threshold value $R_W$ is t2. In addition, suppose that a time at which the rotational acceleration exceeds the threshold value Th1 is t3, and that a time at which the rotational acceleration becomes equal to or less than the threshold value Th1 is t4.

A graph (D) depicts temporal changes in the port pressures of the swing motor 17. The A-port pressure on a driving side rises in relation to a bleed-off aperture and a pump flow rate to be described later.

A graph (E) depicts temporal changes in the swing moment estimated value. The moment estimated value is used for a period from time t3 to time t4. At other times, the reference moment set in the controller 19 is used as the moment estimated value.

A graph (F) depicts temporal changes in the pressure control flag. The pressure control flag is ON from time t1 to time t2.

A graph (G) depicts temporal changes in a bleed-off aperture. From time t1 to time t2, during which the pressure control flag is ON, the control aperture is maintained as the bleed-off aperture. At time t2, the control flag changes from ON to OFF, so that decrease rate limitation is activated, and the aperture is decreased at the rate r1.

A graph (H) depicts temporal changes in a pump flow rate and a swing motor flow rate. During non-operation, the pump flow rate is a minimum flow rate (standby flow rate). When a swing operation is performed and the pressure control flag is ON, a flow rate obtained by adding a bleed-off flow rate to the swing motor flow rate is delivered as the pump flow rate. Here, the bleed-off flow rate is calculated as a flow rate at which the target pressure can be realized when the bleed-off valve 12 maintains the control aperture. When the pressure control flag is turned OFF at time t2, the pump target flow rate gradually approaches the swing motor flow rate due to an effect of the low-pass filter.

Figure 13:
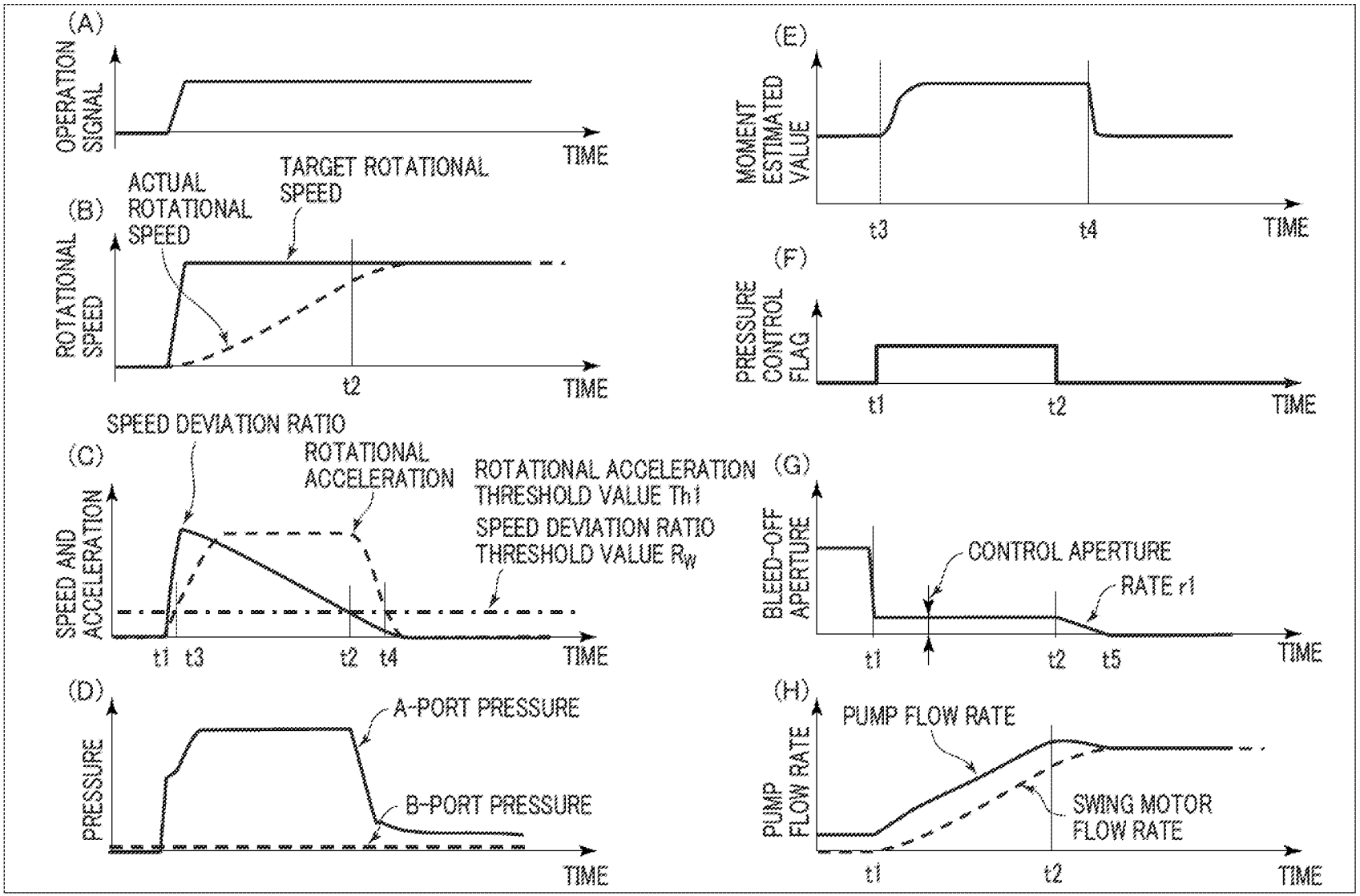
FIG. 13 is a diagram illustrating temporal changes in signals and control amounts when a right swing full lever operation is performed in a state in which the swing moment is large in the embodiment of the present invention.

FIG. 13 depicts temporal changes in signals and control amounts when a right swing full lever operation is performed in a state in which the swing moment is large (in a state in which the bucket 4 contains soil). Unlike FIG. 12, the swing moment is large, so that the rotational acceleration (rate of increase in the actual rotational speed) is small for the same swing pressure (graph (B)). At this time, the moment estimated value is calculated to be large (graph (E)), and the target swing pressure is increased. It is thereby possible to perform swing driving without significantly decreasing the rotational acceleration of the swing motor 17.

<Effects>

In the present embodiment, the hydraulic excavator includes the track structure 1, the swing structure 2 swingably attached onto the track structure 1, the hydraulic operating fluid tank 21, the hydraulic pump 10 that delivers hydraulic operating fluid sucked from the hydraulic operating fluid tank 21, the swing motor 17 that is supplied with the hydraulic operating fluid from the hydraulic pump 10 and drives the swing structure 2, the operation device 20 for giving an instruction for operation of the swing structure 2, the rotational speed sensor 18 that detects the rotational speed of the swing motor 17, the pressure sensors 22*a* and 22*b* that detect a driving pressure of the swing motor 17, the pressure adjusting devices 10*a* and 12 capable of adjusting the driving pressure of the swing motor 17, and the controller 19 that controls the pressure adjusting devices 10*a* and 12, the controller 19 calculating the target rotational speed of the swing motor 17 based on input from the operation device 20, calculate a degree of deviation of the rotational speed detected by the rotational speed sensor 18 from the target rotational speed, set a target driving pressure of the swing motor 17 according to the swing moment as the moment of inertia about the swing axis X of the swing structure 2 and the work device 3 and control the pressure adjusting devices 10*a* and 12 in such a manner as to reduce a difference between the driving pressure detected by the pressure sensors 22*a* and 22*b* and the target driving pressure, when the degree of deviation is larger than the predetermined value $R_W$, and control the pressure adjusting devices 10*a* and 12 in such a manner as to reduce a difference between the rotational speed detected by the rotational speed sensor 18 and the target rotational speed, when the degree of deviation is equal to or smaller than the predetermined value.

According to the present embodiment configured as described above, when the degree of deviation of the rotational speed of the swing motor 17 from the target rotational speed is larger than the predetermined value $R_W$ (that is, when the rotational speed of the swing motor 17 is significantly below the target rotational speed), the driving pressure of the swing motor 17 is controlled in such a manner as to coincide with the target driving pressure set according to the swing moment, and when the degree of deviation is equal to or smaller than the predetermined value $R_W$ (that is, when the rotational speed of the swing motor 17 approaches the target rotational speed), the driving pressure of the swing motor 17 is controlled such that the rotational speed of the swing motor 17 coincides with the target rotational speed. It is thereby possible to promptly adjust the rotational speed of the swing motor 17 to the target rotational speed. Incidentally, while the rotational speed deviation ratio is used as the degree of deviation from the target rotational speed in the present embodiment, the rotational speed deviation may be used as the degree of deviation.

In addition, the hydraulic excavator according to the present embodiment includes the pressure sensors 22*a* and 22*b* that detect the driving pressure of the swing motor 17, and the controller 19 calculates the rotational acceleration of the swing motor 17 based on the rotational speed detected by the rotational speed sensor 18, and calculates the swing moment based on the driving pressure detected by the pressure sensors 22*a* and 22*b* and the rotational acceleration. It is thereby possible to compute the swing moment accurately.

In addition, in the present embodiment, the hydraulic pump 10 is of a variable displacement type, the pressure adjusting devices capable of adjusting the driving pressure of the swing motor 17 include the pump regulator 10*a* capable of adjusting the delivery flow rate of the hydraulic pump 10 and the bleed-off valve 12 disposed on a flow passage that connects the hydraulic pump 10 and the hydraulic operating fluid tank 21 to each other, and the controller 19 controls, when the degree of deviation is equal to or smaller than the predetermined value $R_W$, the pump regulator 10*a* in such a manner as to reduce the difference between the rotational speed detected by the rotational speed sensor 18 and the target rotational speed, in a state in which the bleed-off valve 12 is closed. Thus, when the rotational speed of the swing motor 17 approaches the target rotational speed, the delivery flow rate of the hydraulic pump 10 is controlled in the state in which the bleed-off valve 12 is closed. A hydraulic pressure loss can therefore be reduced. Incidentally, when the hydraulic pump 10 is of a fixed displacement type, the delivery flow rate of the hydraulic pump 10 is controlled by changing an engine rotational speed, for example, and the driving pressure of the swing motor 17 is thereby adjusted. In this case, an engine controller that controls the engine rotational speed corresponds to the pressure adjusting device.

In addition, in the present embodiment, the controller 19 controls, when the degree of deviation is larger than the predetermined value $R_W$, the pump regulator 10*a* in such a manner as to reduce the difference between the driving pressure detected by the pressure sensors 22*a* and 22*b* and the target driving pressure, in a state in which the aperture amount of the bleed-off valve 12 is maintained to be a predetermined aperture amount (control aperture). It is thereby possible to adjust the driving pressure of the swing motor 17 with high accuracy.

An embodiment of the present invention has been described above in detail. However, the present invention is not limited to the foregoing embodiment, and includes various modifications. For example, while the present invention is applied to the hydraulic excavator in the foregoing embodiment, the present invention is applicable to construction machines in general that have a swing structure. In addition, the foregoing embodiment has been described in detail in order to describe the present invention in an easy-to-understand manner, and is not necessarily limited to one including all of the described configurations.

DESCRIPTION OF REFERENCE CHARACTERS

1: Track structure
2: Swing structure
3: Work device
4: Bucket
10: Hydraulic pump
10*a*: Pump regulator (pressure adjusting device)
11: Main relief valve
12: Bleed-off valve (pressure adjusting device)
13: Load check valve
14: Directional control valve
15*a*, 15*b*: Swing relief valve
16*a*, 16*b*: Makeup check valve
17: Swing motor
18: Rotational speed sensor
19: Controller
20: Joystick (operation device)
21: Hydraulic operating fluid tank
22*a*, 22*b*: Pressure sensor

The invention claimed is:

1. A construction machine comprising:
a track structure;
a swing structure swingably attached onto the track structure;
a work device attached to the swing structure;
a hydraulic operating fluid tank;
a hydraulic pump that delivers hydraulic operating fluid sucked from the hydraulic operating fluid tank;
a swing motor that is supplied with the hydraulic operating fluid from the hydraulic pump and drives the swing structure; and
an operation device for giving an instruction for operation of the swing structure, wherein
the construction machine comprises
a rotational speed sensor that detects a rotational speed of the swing motor,
a pressure sensor that detects a driving pressure of the swing motor,
a pressure adjusting device capable of adjusting the driving pressure of the swing motor, and
a controller that controls the pressure adjusting device,
the hydraulic pump is of a variable displacement type,
the pressure adjusting device includes a pump regulator capable of adjusting a delivery flow rate of the hydraulic pump and a bleed-off valve disposed on a flow passage that connects the hydraulic pump and the hydraulic operating fluid tank to each other, and
the controller is configured to
calculate a target rotational speed of the swing motor based on input from the operation device,
calculate a degree of deviation of the rotational speed detected by the rotational speed sensor from the target rotational speed,
set a target driving pressure of the swing motor according to a swing moment as a moment of inertia about a swing axis of the swing structure and the work device and control the pressure adjusting device in such a manner as to reduce a difference between the driving pressure detected by the pressure sensor and the target driving pressure, when the degree of deviation is larger than a predetermined value, and control, when the degree of deviation is equal to or smaller than the predetermined value, the pump regulator in such a manner as to reduce a difference between the rotational speed detected by the rotational speed sensor and the target rotational speed, in a state in which the bleed-off valve is closed.

2. The construction machine according to claim 1, wherein the controller is configured to calculate a rotational acceleration of the swing motor based on the rotational speed detected by the rotational speed sensor, and calculate the swing moment based on the driving pressure detected by the pressure sensor and the rotational acceleration.

3. A construction machine comprising:

a track structure;

a swing structure swingably attached onto the track structure;

a work device attached to the swing structure;

a hydraulic operating fluid tank;

a hydraulic pump that delivers hydraulic operating fluid sucked from the hydraulic operating fluid tank;

a swing motor that is supplied with the hydraulic operating fluid from the hydraulic pump and drives the swing structure; and an operation device for giving an instruction for operation of the swing structure, wherein the construction machine comprises a rotational speed sensor that detects a rotational speed of the swing motor, a pressure sensor that detects a driving pressure of the swing motor, a pressure adjusting device capable of adjusting the driving pressure of the swing motor, and a controller that controls the pressure adjusting device, the hydraulic pump is of a variable displacement type, the pressure adjusting device includes a pump regulator capable of adjusting a delivery flow rate of the hydraulic pump and a bleed-off valve disposed on a flow passage that connects the hydraulic pump and the hydraulic operating fluid tank to each other, and the controller is configured to calculate a target rotational speed of the swing motor based on input from the operation device, calculate a degree of deviation of the rotational speed detected by the rotational speed sensor from the target rotational speed, set a target driving pressure of the swing motor according to a swing moment as a moment of inertia about a swing axis of the swing structure and the work device and control the pump regulator in such a manner as to reduce a difference between the driving pressure detected by the pressure sensor and the target driving pressure, in a state in which an aperture amount of the bleed-off valve is maintained to be a predetermined aperture amount, when the degree of deviation is larger than a predetermined value, and control, when the degree of deviation is equal to or smaller than the predetermined value, the pressure adjusting device in such a manner as to reduce a difference between the rotational speed detected by the rotational speed sensor and the target rotational speed.

* * * * *